US008540591B2

(12) United States Patent
Slane

(10) Patent No.: US 8,540,591 B2
(45) Date of Patent: Sep. 24, 2013

(54) SQUEEZE PRESSURE INDICATING GOLF CLUB GRIP

(75) Inventor: Michael Dominick Slane, San Anselmo, CA (US)

(73) Assignee: Michael D. Slane, San Anselmo, CA (US)

( * ) Notice: Subject to any disclaimer, the term of this patent is extended or adjusted under 35 U.S.C. 154(b) by 241 days.

(21) Appl. No.: 12/657,849

(22) Filed: Jan. 29, 2010

(65) Prior Publication Data

US 2011/0190069 A1 Aug. 4, 2011

(51) Int. Cl.
*A63B 69/36* (2006.01)
*A63B 53/14* (2006.01)

(52) U.S. Cl.
USPC ..... 473/409; 473/300; 473/301

(58) Field of Classification Search
USPC ..... 473/201, 202, 206, 219, 220, 221, 473/222, 223, 224, 409
See application file for complete search history.

(56) References Cited

U.S. PATENT DOCUMENTS

| | | | | |
|---|---|---|---|---|
| 584,220 | A | 6/1897 | Gunsaul | |
| 3,323,367 | A * | 6/1967 | Searle | 473/202 |
| 4,509,228 | A | 4/1985 | Landsberger | |
| 5,322,289 | A * | 6/1994 | Abrams et al. | 473/202 |
| 5,355,552 | A | 10/1994 | Huang | |
| 5,542,676 | A * | 8/1996 | Howe et al. | 473/202 |
| 5,846,145 | A | 12/1998 | Tinlin | |
| 6,821,218 | B2 | 11/2004 | Byrne et al. | |
| 7,407,444 | B2 | 8/2008 | Cera | |
| 7,607,990 | B1 | 10/2009 | Slane | |
| 2002/0142856 | A1 | 10/2002 | Lindsey | |
| 2005/0043110 | A1 | 2/2005 | Lindsey | |
| 2006/0009304 | A1 | 1/2006 | Tremulis et al. | |
| 2006/0205529 | A1 | 9/2006 | Cera | |

* cited by examiner

*Primary Examiner* — Nini Legesse

(57) ABSTRACT

A method is provided for gauging the squeeze pressure of a golf club which generally includes the steps of providing a golf club having an elongated shaft, placing an expanded synthetic rubber, internally ribbed cushioning device with adjustable pressure sensors over the distal end of the shaft, the expanded synthetic rubber, internally ringed cushioning device comprising a sheath to surround the proximal end of the shaft along a desired length and being constructed of expanded synthetic rubber of a density predetermined by the manufacturer to require the golfer to apply with both hands optimum squeeze pressure for maximum control of golf strokes in order to feel the ringed protrusions enveloped therein. A cushioning and training apparatus is also provided, which includes adjustable pressure sensors enveloped by ringed protrusions that signal an audible device to sound and a light emitting diode (LED) to illuminate when optimum squeeze pressure for maximum control of strokes is applied with both hands by the golfer. A removable control unit at the butt end of the invention may be used to adjust the sensitivity of the pressure sensors and disable the LED and audible device as desired.

12 Claims, 2 Drawing Sheets

SQUEEZE PRESSURE INDICATING GOLF CLUB GRIP

CROSS-REFERENCE TO RELATED APPLICATIONS

Not Applicable

FEDERALLY SPONSORED RESEARCH

Not Applicable

SEQUENCE LISTING OF PROGRAM

Not Applicable

BACKGROUND OF THE INVENTION

1. Field of Invention

This invention generally relates to golf club accessories, specifically golf club grips.

2. Prior Art

Golfers of all skill levels experience increased difficulty putting when mental stress level is high and an affliction known as "the yips" is encountered. Characterized by elevated blood pressure, perspiration, pulse and respiratory rates, the yips are commonly triggered by the psychological stress of sinking an important putt, and often result in the failure to execute an otherwise routine stroke.

For the sake of describing this invention, "the yips" will refer to mental stress induced mistakes of golf swings both on and off the putting green.

During full swings off the putting green, many golfers find themselves swinging too fast or jerky as a result of gripping the club too tightly. Golfers experiencing both the psychological and physiological effects of the yips are often unaware that they are squeezing the club too tightly (or lightly) while swinging, and consequently abandon one of the fundamentals of an accurate golf stroke.

This invention is an expanded synthetic rubber golf club grip that employs tactile, audible, and visual methods of indicating when optimum squeeze pressure is applied by both hands of the golfer for maximum control of golf strokes.

U.S. Pat. No. 7,607,990 for The Yip Grip is the only prior art as pertains to golf club grips that addresses the yip-afflicted golfer's need for a means of indicating optimum club squeeze pressure for maximum control of golf strokes. This invention is different, in that there are no inflatable bladders, and hence the optimum squeeze pressure required to feel internal ringed protrusions is pre-set by the manufacturer as a function of the density of the grip's expanded synthetic rubber construction. Also, unlike the Yip Grip, this invention utilizes adjustable pressure sensors within the grip that activate an audible device and illuminate a light emitting diode (LED) on the butt end of the grip when the optimum squeeze pressure is being applied with both hands by the golfer. The audible device and LED may be disabled by de-energizing or removing the control unit.

Objects and Advantages

Accordingly, several objects and advantages of my invention are:

(a) a mechanism for training golfers to apply optimum grip squeeze pressure with both hands for maximum stability and control of clubs while executing strokes.

(b) as a training aid, the golfer will feel ribbed protrusions within the grip as a tactile means of determining when optimum squeeze pressure for maximum stability and control is being applied by both hands to the golf club grip.

(c) as a training aid, the golfer will hear a signal from an audible device triggered by adjustable pressure sensors within the grip that optimum squeeze pressure for maximum stability and control is being applied by both hands to the golf club grip.

(d) as a training aid, the golfer will see an LED illuminate when triggered by adjustable pressure sensors within the grip that optimum squeeze pressure for maximum stability and control is being applied by both hands to the golf club grip.

(e) as a training aid, the golfer will be able to disable the audible device and LED by de-energizing or removing the control unit.

(f) as a training aid, the simultaneous triple combination of tactile, audible, and visual indicators have a synergistic effect in training the golfer to recognize when optimum squeeze pressure for maximum stability and control is being applied by both hands to the golf club grip.

Further objects and advantages will become apparent from consideration of the ensuing description and drawings.

SUMMARY

In accordance with the invention, this squeeze pressure indicating grip comprises a golf club grip with simultaneous tactile, audible, and visual means of enabling the golfer to recognize when optimum club squeeze pressure for maximum stability and control of golf strokes is being applied by both hands to the golf club grip, resulting in a steady, more confident, and accurate stroke.

DRAWINGS

Figures

DRAWINGS

Reference Numerals

Figure 1:
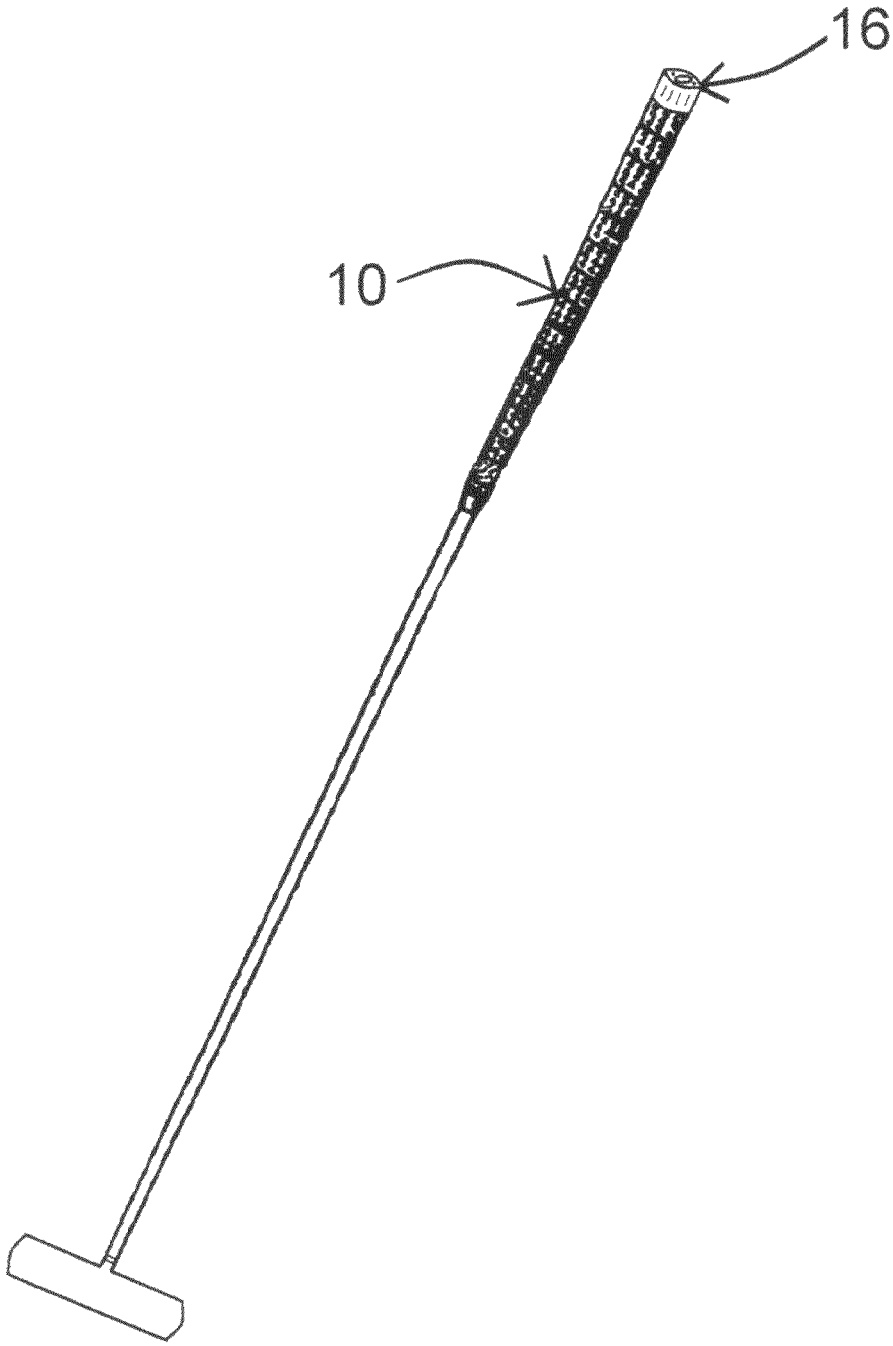
FIG. 1 shows a perspective view of the invention installed on the shaft of a golf club.
Figure 2:
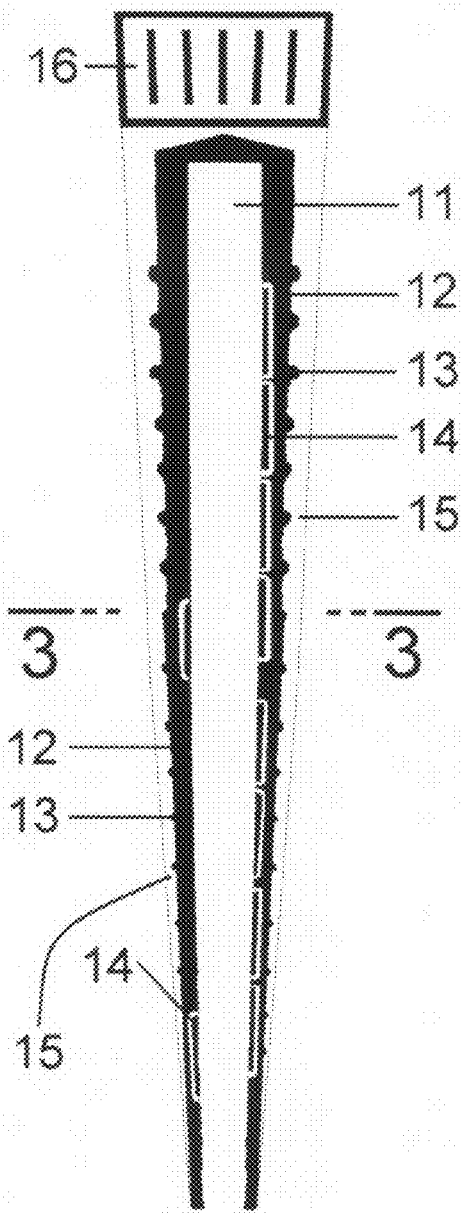
FIG. 2 shows a medial sectional view of the invention.
Figure 3:
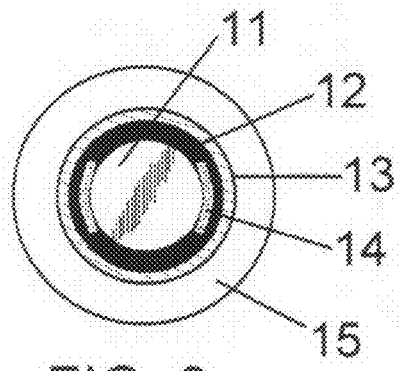
FIG. 3 shows a top sectional view of the invention.

| | |
|---|---|
| 10 present invention | 11 hollow core |
| 12 inner wall | 13 ringed protrusion of inner wall |
| 14 pressure sensor | 15 expanded synthetic rubber |
| 16 removable control unit for pressure sensors, audible device, and LED | |

DETAILED DESCRIPTION

FIGS. 1,2,3

Referring now to the drawings in greater detail, reference number 10 represents the golf club grip of synthetic rubber construction, according to the present invention, whereby a hollow center core 11 is to accommodate the club shaft. From center outward are: the inner wall 12, comprising one-eighth inch circular ringed protrusions 13, every half inch. The inner wall 12, and ringed protrusions 13 envelop ten adjustable pressure sensors 14, and are enveloped, in turn, by expanded synthetic rubber 15. An audible device and LED are located inside, and are controlled by a removable control unit 16, that also controls sensitivity adjustment of the pressure sensors, 14. The invention may also be manufactured without the ringed protrusions 13, providing audible and visual, but no tactile feedback.

Operation

FIGS. 1,2,3

In operation, this invention 10 is mounted with its hollow core 11 over the proximal end of a golf club shaft such that, when the golfer applies with both hands optimum grip squeeze pressure for maximum stability and control of stroke, as determined by the manufacturer as a function of the density of the expanded synthetic rubber construction 15, ringed protrusions 13 of the inner wall 12 are felt and pressure sensors 14 signal a removable control unit 16 to emit a signal from an audible device and illuminate a LED contained therein. The golfer may adjust the sensitivity of the pressure sensors 14 with said control unit 16 and disable the audible device and LED by de-energizing or removing it. The invention may also be manufactured without the ringed protrusions 13, providing audible and visual, but no tactile feedback.

The invention claimed is:

1. A method of training a golfer to apply optimum grip squeeze pressure for maximum control of strokes comprising the steps of: providing a golf club having an elongated shaft, the elongated shaft having a proximal end to be grasped by a user; placing a grip consisting of expanded synthetic rubber cushioning and training apparatus over the proximal end of the shaft, the expanded synthetic rubber cushioning and training apparatus comprising a sheath configured to surround the proximal end of the shaft along a desired length to cushion the grip and train the user to apply with both hands optimum squeeze pressure for maximum control of strokes; wherein the cushioning apparatus further comprises an elongated inner wall comprising ringed protrusions embedded within said cushioning apparatus constructed of expanded synthetic rubber of a density predetermined by the manufacturer to require optimum squeeze pressure for maximum control of strokes be applied with both hands by the golfer in order to feel said ringed protrusions therein; and wherein the cushioning apparatus consists of expanded synthetic rubber construction consisting of adjustable pressure sensors at said ringed protrusions to signal when optimum squeeze pressure for maximum control of strokes is applied with both hands by the golfer.

2. The method of claim 1, wherein the grip further comprises a beeper hard wired to said pressure sensors and activated when optimum squeeze pressure for maximum control of strokes is applied with both hands by the golfer.

3. The method of claim 1, wherein the grip further comprises an LED hard wired to said pressure sensors to illuminate when optimum squeeze pressure for maximum control of strokes is applied with both hands by the golfer.

4. The method of claim 1, wherein the method further comprises the steps of: removing a conventional golf club grip from a shaft of a golf club and replacing it with a grip consisting of the expanded synthetic rubber cushioning and training apparatus.

5. The method of claim 1, wherein the grip further comprises an outer surface of the expanded synthetic rubber cushioning and training apparatus defines a golf grip to be engaged by the hands of a golfer.

6. The method of claim 1, wherein the grip further comprises a control unit for adjusting the sensitivity of pressure sensors activated when optimum squeeze pressure is applied by the golfer is aligned with a through-opening in the butt of the golf club.

7. The method of claim 6 wherein the grip further comprises a beeper for emitting an audible tone when receiving a signal from pressure sensors activated when optimum squeeze pressure is applied by the golfer is aligned with, the through-opening in the butt of the golf club.

8. The method of claim 7 wherein the grip further allows that said beeper may be disabled by removing said control unit aligned with the through-opening in the butt of the golf club.

9. The method of claim 6 wherein the grip further comprises a data logger in said control unit that may be downloaded to an external source in order to analyze stroke mechanics.

10. The method of claim 1, wherein the grip further comprises an LED to be illuminated when receiving a signal from pressure sensors activated when optimum squeeze pressure is applied by the golfer is aligned with the through-opening in the butt of the golf club.

11. The method of claim 10, wherein said LED may be disabled by removing said control unit aligned with the through-opening in the butt of the golf club.

12. An improved golf club, comprising: an elongated shaft having a distal end and a proximal end, the proximal end to be grasped by the user; a head at the distal end of the shaft; a butt at the end of the proximal end of the shaft, the butt having a through-opening; and an expanded synthetic rubber cushioning and training apparatus placed over the proximal end of the shaft, the expanded synthetic rubber cushioning and training apparatus comprising a single elongated sheath configured to surround the proximal end of the shaft along a desired length; and wherein the cushioning apparatus further comprises an elongated inner wall comprising ringed protrusions to be felt by the user when optimum squeeze pressure for maximum control of strokes is applied with both hands to the outer surface of the expanded synthetic rubber cushioning and training apparatus; and wherein adjustable pressure sensors being enveloped by said ringed protrusions for the purpose of signaling an audible tone from a beeper and illuminating an LED when optimum squeeze pressure for maximum control of strokes is applied with both hands by the user to the expanded synthetic rubber cushioning and training apparatus, wherein said removable control unit for the beeper, LED, and apparatus for adjusting sensitivity of said pressure sensors being aligned through the opening in the butt.

* * * * *